US010297184B2

(12) United States Patent
Jeong et al.

(10) Patent No.: US 10,297,184 B2
(45) Date of Patent: May 21, 2019

(54) DISPLAY DEVICE AND METHOD OF DRIVING DISPLAY DEVICE

(71) Applicant: Samsung Display Co., LTD., Yongin-si, Gyeonggi-Do (KR)

(72) Inventors: Il-Hun Jeong, Yongin-si (KR); Jae-Hoon Lee, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 633 days.

(21) Appl. No.: 14/861,089

(22) Filed: Sep. 22, 2015

(65) Prior Publication Data

US 2016/0293101 A1 Oct. 6, 2016

(30) Foreign Application Priority Data

Apr. 6, 2015 (KR) ..... 10-2015-0048378

(51) Int. Cl.
*G09G 3/20* (2006.01)
*G09G 3/3258* (2016.01)

(52) U.S. Cl.
CPC ..... *G09G 3/2007* (2013.01); *G09G 3/3258* (2013.01); *G09G 2300/0866* (2013.01); *G09G 2300/0876* (2013.01); *G09G 2320/0223* (2013.01); *G09G 2330/021* (2013.01); *G09G 2330/028* (2013.01); *G09G 2360/16* (2013.01)

(58) Field of Classification Search
CPC ..... G09G 3/2007; G09G 3/3258; G09G 2360/16; G09G 2320/0223; G09G 2300/0876; G09G 2300/0866; G09G 2330/021; G09G 2330/028
See application file for complete search history.

(56) References Cited

U.S. PATENT DOCUMENTS

2005/0285825 A1* 12/2005 Eom ..... G09G 3/3233 345/76
2007/0171149 A1* 7/2007 Hashimoto ..... G09G 3/2942 345/60
2008/0252559 A1* 10/2008 Chung ..... G09G 3/2803 345/60
2009/0184894 A1* 7/2009 Sato ..... G09G 3/2803 345/60
2010/0134462 A1* 6/2010 Kim ..... G09G 3/3688 345/211

FOREIGN PATENT DOCUMENTS

JP 2008256827 A 10/2008
KR 1020050042193 A 5/2005
KR 1020050123325 A 12/2005
KR 100833758 B1 5/2008
KR 1020080057434 A 6/2008
KR 1020080101679 A 11/2008
KR 1020120014775 A 2/2012
KR 1020130092924 A 8/2013

* cited by examiner

*Primary Examiner* — Aneeta Yodichkas
(74) *Attorney, Agent, or Firm* — Cantor Colburn LLP

(57) ABSTRACT

A method of driving a display device includes calculating an average load and an asymmetry by analyzing an input image data, and adjusting at least one of a high data voltage and a low data voltage, which are supplied to a display panel of the display device, based on the average load and the asymmetry.

8 Claims, 12 Drawing Sheets

DISPLAY DEVICE AND METHOD OF DRIVING DISPLAY DEVICE

This application claims priority to Korean Patent Application No. 10-2015-0048378, filed on Apr. 6, 2015, and all the benefits accruing therefrom under 35 U.S.C. § 119, the content of which in its entirety is herein incorporated by reference.

BACKGROUND

1. Field

Exemplary embodiments of the invention relate to a display device. More particularly, exemplary embodiments of the invention relate to a display device and a method of driving the display device that adaptively controls a voltage.

2. Description of the Related Art

Generally, an organic light emitting display device displays an image using an organic light emitting diode that emits light based on recombination of electrons and holes.

Driving the organic light emitting display device may be classified into one of an analog driving or a digital driving based on a representation manner of a grayscale. The analog driving represents the grayscale by controlling the organic light emitting diode to emit light during a constant light emitting time period and changing a level of a data voltage to be supplied to a pixel. The digital driving represents the grayscale by supplying a constant data voltage and changing a light emitting time period in which the organic light emitting diode emits light. The digital driving may allow a pixel and/or a driving integrated circuit to have simpler structures than those of the analog driving. Therefore, as a size and a resolution of a display panel increase, the digital driving is more widely used.

SUMMARY

In a digital driving method of an organic light emitting display device, power consumption may increase and quality of image may be lowered due to a current-resistance ("IR") drop (or an ohmic drop) of power voltages supplied to a display panel thereof, a variation of temperature, a characteristic deviation of an organic light emitting diode thereof, etc.

Some exemplary embodiments provide a method of driving a display device that decreases power consumption and improves quality of an image by using an adaptive voltage control.

Some exemplary embodiments provide a display device that performs the method.

According to exemplary embodiments, a method of driving a display device includes generating a plurality of sub-image data by dividing an input image data supplied to a display panel of the display device into the plurality of sub-image data corresponding to a plurality of blocks of the display panel, respectively, calculating sub-loads for the plurality of blocks based on the plurality of sub-image data, respectively, and adjusting at least one of a high data voltage and a low data voltage, which are supplied to the display panel, by analyzing the sub-loads.

In exemplary embodiments, the high data voltage may be a data voltage for turning off a driving transistor included in a pixel of the display panel, and the low data voltage may be a data voltage for turning on the driving transistor.

In exemplary embodiments, the calculating the sub-loads may include calculating average grayscales for the plurality of blocks based on the plurality of sub-image data, respectively, and calculating the sub-loads based on the average grayscales, respectively.

In exemplary embodiments, the adjusting the at least one of the high data voltage and the low data voltage may include calculating an asymmetry of the input image data based on the sub-loads, and generating a voltage control signal, which changes at least one of the high data voltage and the low data voltage, based on the sub-loads and the asymmetry.

In exemplary embodiments, the generating the voltage control signal may include generating the voltage control signal based on at least one of a selected sub-load and the asymmetry when the asymmetry is within a specified range, where the selected sub-load is selected among the sub-loads, and generating the voltage control signal based on an average load of the sub-loads when the asymmetry is out of the specified range.

In exemplary embodiments, the generating the voltage control signal may include selecting a minimum sub-load of the sub-loads, and generating the voltage control signal based on the minimum sub-load, where the voltage control signal adjusts the high data voltage.

In exemplary embodiments, the generating the voltage control signal may include selecting a maximum sub-load of the sub-loads, and generating the voltage control signal based on the maximum sub-load, where the voltage control signal adjusts the low data voltage.

In exemplary embodiments, the generating the voltage control signal may include determining a supply voltage level of a first power voltage, which is supplied to the display panel, calculating a first IR drop of the first power voltage by analyzing the sub-loads, calculating a first local voltage level of the first power voltage by subtracting the first IR drop from the supply voltage level, calculating a first target voltage level by subtracting a first offset voltage from the first local voltage level, and generating the voltage control signal based on the first target voltage level, where the voltage control signal adjusts the low data voltage.

In exemplary embodiments, the first IR drop of the first power voltage may be calculated based on a minimum sub-load of the sub-loads.

In exemplary embodiments, a driving transistor included in a pixel of the display panel may be turned off in response to the high data voltage, and the first offset voltage may have a substantially constant level determined based on a gate-source voltage of the turned-off driving transistor.

In exemplary embodiments, the adjusting the at least one of the high data voltage and the low data voltage may include determining a supply voltage level of a first power voltage, which is supplied to the display panel, calculating a second IR drop of the first power voltage by analyzing the sub-loads, calculating a second local voltage level of the first power voltage by subtracting the second IR drop from the supply voltage level, calculating a second target voltage level by subtracting a second offset voltage from the second local voltage level, and generating the voltage control signal based on the second target voltage level, where the voltage control signal adjusts the low data voltage.

In exemplary embodiments, the second IR drop of the first power voltage may be calculated based on a maximum sub-load of the sub-loads.

In exemplary embodiments, a driving transistor included in a pixel of the display panel may be turned on in response to the low data voltage, and the second offset voltage may have a substantially constant level determined based on a gate-source voltage of the turned-on driving transistor.

According to exemplary embodiments, a method of driving a display device, the method includes calculating an average load and an asymmetry by analyzing an input image data, and adjusting at least one of a high data voltage and a low data voltage, which are supplied to a display panel of the display device, based on the average load and the asymmetry.

In exemplary embodiments, the calculating the average load and the asymmetry may include generating a plurality of sub-image data by dividing the input image data into the plurality of sub-input image data corresponding to a plurality of blocks of the display panel, respectively, calculating sub-loads of the plurality of blocks based on the plurality of sub-input image data, respectively, calculating the average load based on the sub-loads, and calculating the asymmetry based on the sub-loads and the average load.

In exemplary embodiments, the adjusting the at least one of the high data voltage and the low data voltage may include generating a voltage control signal, which adjusts at least one of the high data voltage and the low data voltage, based on the average load, and compensating the voltage control signal based on the asymmetry.

In exemplary embodiments, the compensating the voltage control signal may include determining whether the asymmetry is within a specified range, selecting a minimum sub-load among the sub-loads when the asymmetry is within the specified range, and compensating the voltage control signal based on the minimum sub-load where the voltage control signal adjusts the high data voltage.

In exemplary embodiments, the compensating the voltage control signal may include, determining whether the asymmetry is within a specified range, selecting a maximum sub-load among the sub-loads when the asymmetry is within the specified range, and compensating the voltage control signal based on the maximum sub-load, where the voltage control signal adjusts the low data voltage.

According to exemplary embodiments, a display device includes a display panel, a sub-load calculator which generates a plurality of sub-image data by dividing an input image data into a plurality of blocks and calculates sub-loads for the plurality of blocks based on the plurality of sub-input image data, respectively, a data voltage controller which calculates an asymmetry of the input image data based on the sub-loads and generates a voltage control signal based on the sub-loads and the asymmetry, and a power supplier which adjusts at least one of a high data voltage and a low data voltage based on the voltage control signal, where the high data voltage and the low data voltage are supplied to the display panel.

In exemplary embodiments, the high data voltage may be a data voltage for turning off a driving transistor included in a pixel of the display panel, and the low data voltage may be a data voltage for turning on the driving transistor.

Therefore, in exemplary embodiments of the invention, a display device and a method of driving the display device may perform an adaptive voltage control based on an asymmetry of loads of a display panel. Therefore, in such embodiment, the display device and the method of driving the display panel may effectively decrease power consumption of the display panel and improves quality of an image.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
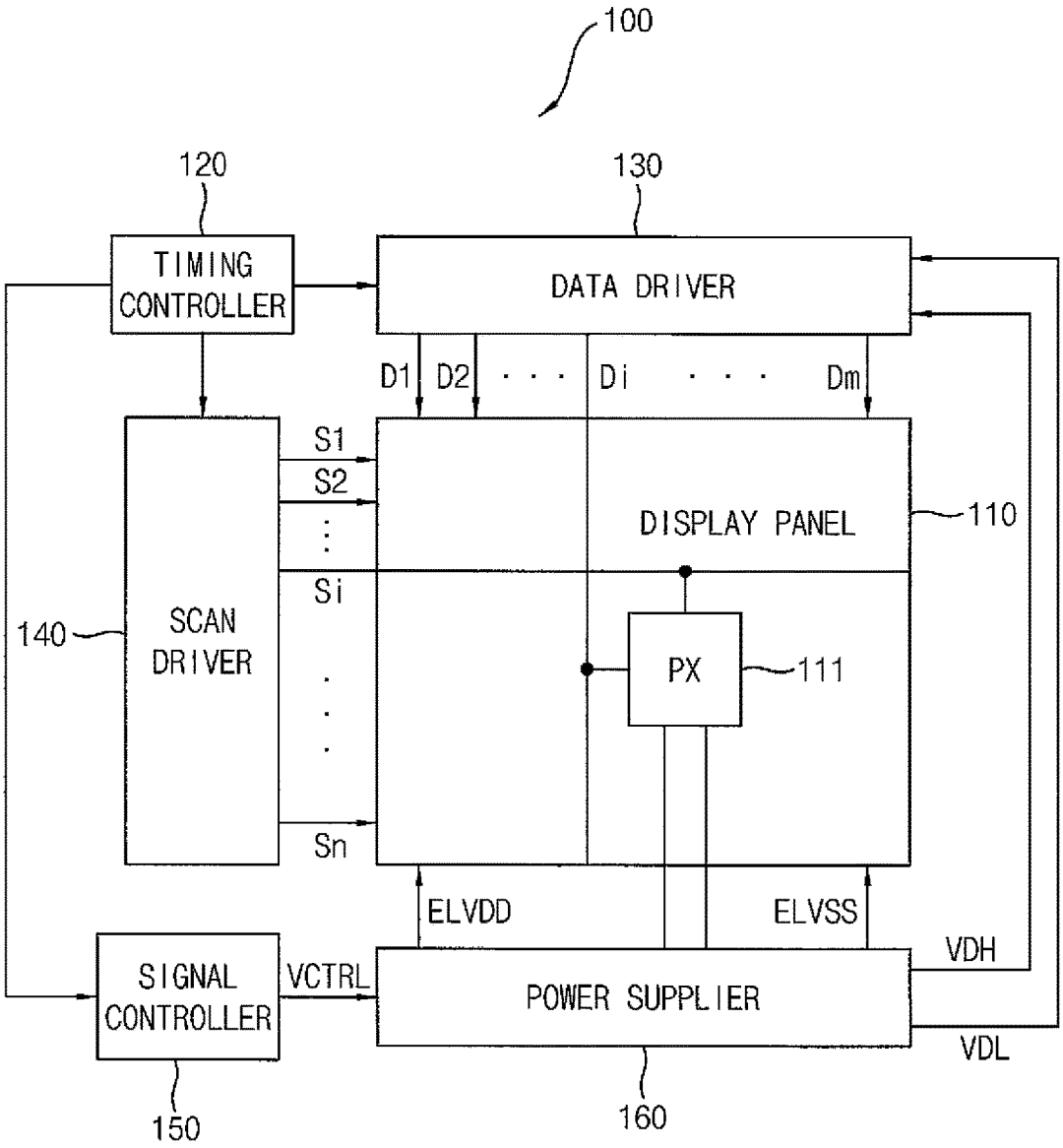
FIG. 1 is a block diagram illustrating an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

FIG. 1 is a block diagram illustrating an exemplary embodiment of a display device according to the invention.

Referring to FIG. 1, an exemplary embodiment of the display device 100 may include a display panel 110, a timing controller 120, a data driver 130, a scan driver 140, a signal controller 150 and a power supplier 160. In such an embodiment, the display device 100 may be an organic light emitting display device.

The display panel 110 may include pixels 111 disposed in intersections of scan lines S1, S2, Si and Sn, and data lines D1, D2, Di and Dm. In an exemplary embodiment, the pixels 111 may be substantially in a matrix form. The pixels 111 may include a light emitting component. In one exemplary embodiment, for example, the light emitting component may include an organic light emitting diode.

Each of the pixels 111 may store a data signal supplied through the data lines D1, D2, Di and Dm, in response to a scan signal supplied through the scan lines S1, S2, Si and Sn. Each of the pixels 111 may emit light in response to the data signal. In an exemplary embodiment, each of the pixels 111 may control a current, which is supplied from a first power voltage ELVDD to a second power voltage ELVSS through an organic light emitting diode, in response to the data signal transferred through the data lines D1, D2, Di and Dm. The organic light emitting diode may represent a grayscale by emission or non-emission in response to the stored data signal. The pixel 111 will be described later in greater detail with reference to FIG. 2.

The timing controller 120 may control an operation of the display device 100. The timing controller 120 may generate a data driving control signal and may provide the data driver 130 with the data driving control signal. The timing controller 120 may generate a scan control signal and may provide the scan control signal to the scan driver 140. The timing controller 120 may provide the input image data to the signal controller 150. In an exemplary embodiment, a first power voltage ELVDD, a high data voltage VDH, and a low data voltage VDL may be controlled based on the input image data.

The data driver 130 may generate a data signal based on the input image data and may provide the data signal to the pixels 111 through the data lines D1, D2, Di and Dm. The data driver 130 may generate the data signal from the input image data by using a gamma filter, digital-analog converter ("DAC"), etc. Here, the data signal may be outputted to a plurality of pixels 111 in a same column.

The scan driver 140 may generate a scan signal and a light emitting control signal based on the scan driving control signal and may provide the pixels 111 with the scan signal and the light emitting control signal through the scan lines S1, S2, Si and Sn, and light emitting control lines. The scan control signal may include a start pulse and a clock pulse, and the scan driver 140 may include a shift register which sequentially generates the scan signal based on the start pulse and the clock pulse.

Each of the scan lines S1, S2, Si and Sn, and each of the light emitting control lines may be electrically connected to the pixels 111 in a same row. The scan signal and a light emitting control signal may be sequentially or simultaneously output.

The signal controller 150 may generate a plurality of sub-image data based on the input image data from the timing controller 120. The signal controller 150 may calculate a sub-load corresponding to each of the sub-image data, and the signal controller 150 may generate a voltage control signal VCTRL to control data voltages VDH and VDL based on the sub-load. The signal controller 150 will be described later in greater detail with reference to FIGS. 3 and 4.

The signal controller 150 may be disposed in the timing controller 120 or the power supplier 160.

In some exemplary embodiment, the timing controller 120, the data driver 130, the scan driver 140 and the signal controller 150 may be included in a single integrated circuit. In some exemplary embodiments, the timing controller 120, the data driver 130, the scan driver 140 and the signal controller 150 may be included in a plurality of integrated circuits.

The power supplier 160 may generate the first power voltage ELVDD and a second power voltage ELVSS. The power supplier 160 may generate the high data voltage VDH and the low data voltage VDL based on the voltage control signal VCTRL. The power supplier 160 may supply the data driver 130 with the high data voltage VDH and the low data voltage VDL. The first power voltage ELVDD and the second power voltage ELVSS may be power voltages to drive each of the pixels 111. The first power voltage ELVDD may have a voltage level higher than that of the second power voltage ELVSS. The power supplier 160 may include a direct current-to-direct current ("DC-DC") converter.

The power supplier 160 may change the first power voltage ELVDD in response to the power voltage control signal provided from the signal controller 150. The power supplier 160 may change the data voltages VDH and VDL in response to the voltage control signal VCTRL provided from the signal controller 150.

Figure 2A:
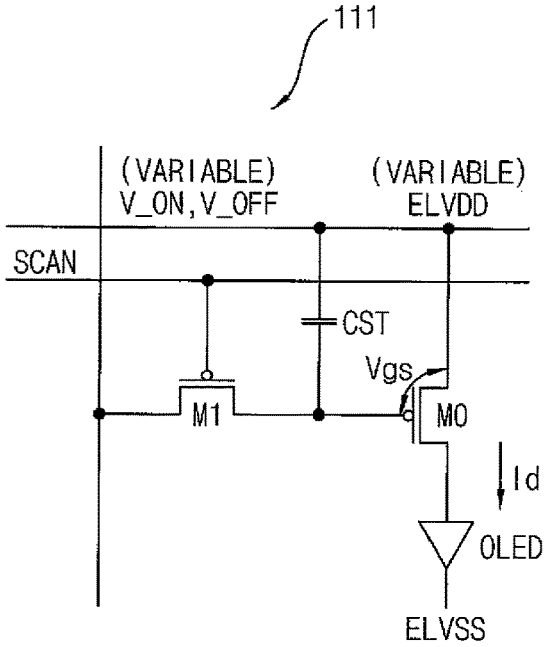
FIG. 2A is a block diagram illustrating an exemplary embodiment of a pixel in the display device of FIG. 1.
Figure 2B:
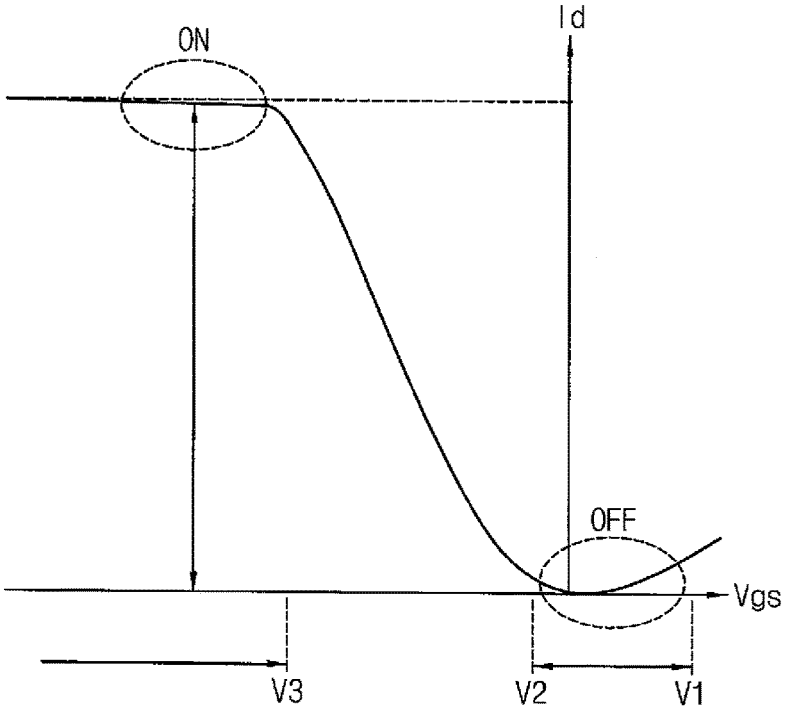
FIG. 2B is a diagram illustrating an operating characteristic of the pixel of FIG. 2A.

FIG. 2A is a block diagram illustrating an exemplary embodiment of a pixel in the display device of FIG. 1, and FIG. 2B is a diagram illustrating an operating characteristic of the pixel of FIG. 2A.

Referring to FIG. 2A, the pixel 111 may include a driving transistor M0, a switching transistor M1, a storage capacitor CST, and an organic light emitting diode OLED.

A gate electrode of the switching transistor M1 may be electrically connected to a scan line. A first electrode of the switching transistor M1 may be electrically connected to a data line, and a second electrode of the switching transistor M1 may be electrically connected to a gate electrode of the driving transistor M0. The switching transistor M1 may provide data voltages V_ON and V_OFF to the storage capacitor CST in response to a scan signal SCAN supplied through the scan line.

The storage capacitor CST may be electrically connected between the first power voltage ELVDD and the gate electrode of the driving transistor M0. The storage capacitor CST may store the data voltages V_ON and V_OFF supplied through the switching transistor M1. Here, the data voltages V_ON and V_OFF may include the high data voltage VDH or the low data voltage VDL. The high data voltage VDH may be a data voltage to turn off the driving transistor M0, and the low data voltage VDL may be a data voltage to turn on the driving transistor M0.

The gate electrode of the driving transistor M0 may be electrically connected to the second electrode of the switching transistor M1. A first electrode of the driving transistor M0 may be electrically connected to the first power voltage ELVDD, and a second electrode of the driving transistor M0 may be electrically connected to a cathode electrode of the organic light emitting diode OLED. The driving transistor M0 may be turned on or off in response to the data voltages V_ON and V_OFF. Therefore, the driving transistor M0 may provide a current supplied from the first power voltage ELVDD to the organic light emitting diode OLED.

The organic light emitting diode OLED may be electrically connected between the second electrode of the driving transistor M0 and the second power voltage ELVSS. The organic light emitting diode OLED may emit light corresponding to a current supplied through the driving transistor M0.

FIG. 2A shows an exemplary embodiment of the pixel 111 having a structure that allows to control an amount of the current flowing in the pixel 111 by controlling the first power voltage ELVDD, but not being limited thereto.

In FIG. 2B, an X axis represents a gate-source voltage Vgs of the driving transistor M0, and a Y axis represents a driving current which flows through the driving transistor M0.

When the gate-source voltage Vgs is in a predetermined range (e.g., V1 through V2), the driving transistor M0 may be turned off. When the gate-source voltage Vgs is lower than a predetermined level (e.g., V3), the driving current Id may be saturated, and the driving transistor M0 may be turned on.

When the gate-source voltage Vgs is between a third voltage V3 and a second voltage V2, the driving transistor M0 may be operated in a linear area. Therefore, a leakage current may occur.

The first power voltage ELVDD supplied to the pixel 111 may be changed due to a current-resistance ("IR") drop (or, an Ohmic drop), and the gate-source voltage Vgs may be thereby different from a target voltage. The luminance-current-voltage ("LIV") characteristic of the display panel 100 may be changed due to a variation of a driving condition of the display panel 100 (e.g., a driving temperature, degradation of a pixel, etc.). In an exemplary embodiment, although the driving condition of the display panel 100 varies, the gate-source voltage Vgs may be maintained substantially constant for a normal operation of the driving transistor M0.

Hereinafter, an adaptive voltage control performed in an exemplary embodiment to maintain the gate-source voltage Vgs substantially at a constant level will be described in detail.

Figure 3A:
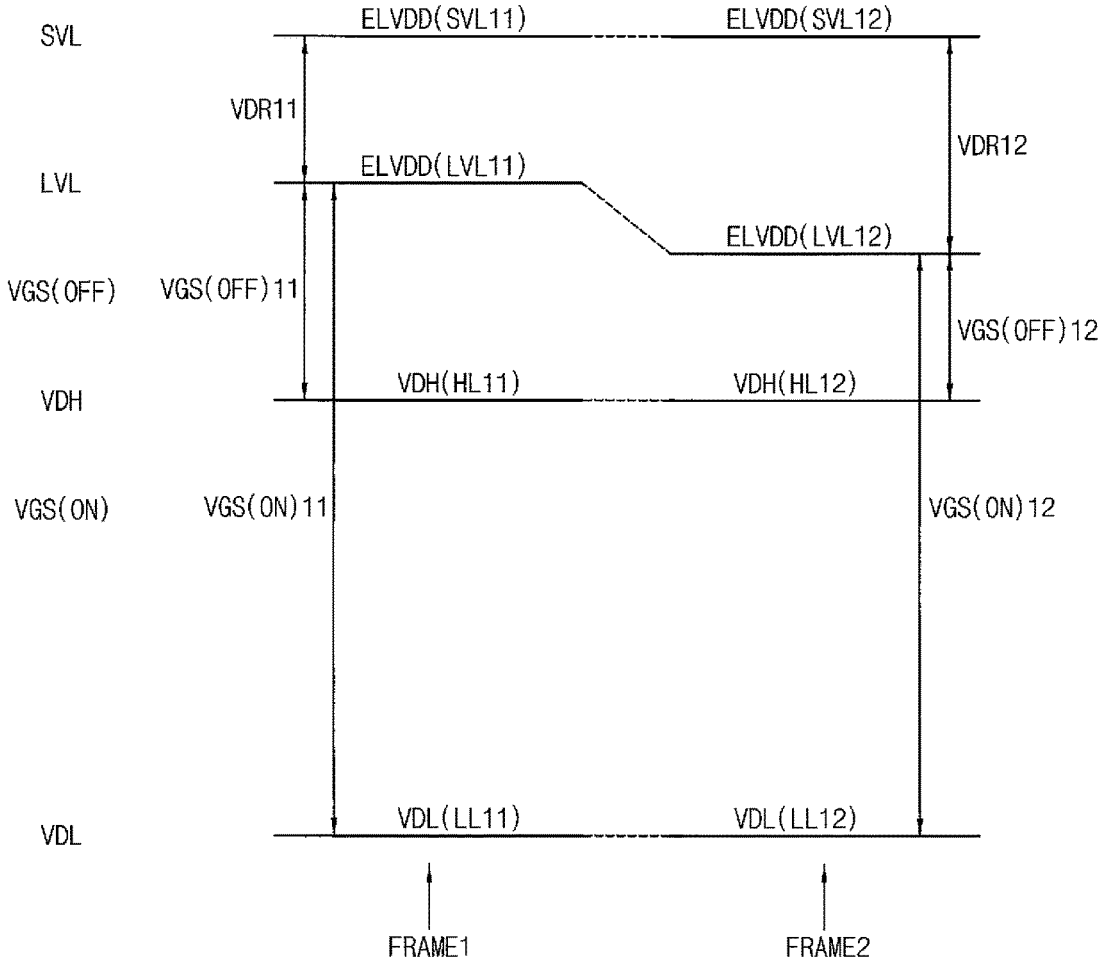
FIGS. 3A and 3B are diagrams for explaining a voltage control performed by an exemplary embodiment of a signal controller in the display device of FIG. 1.
Figure 3B:
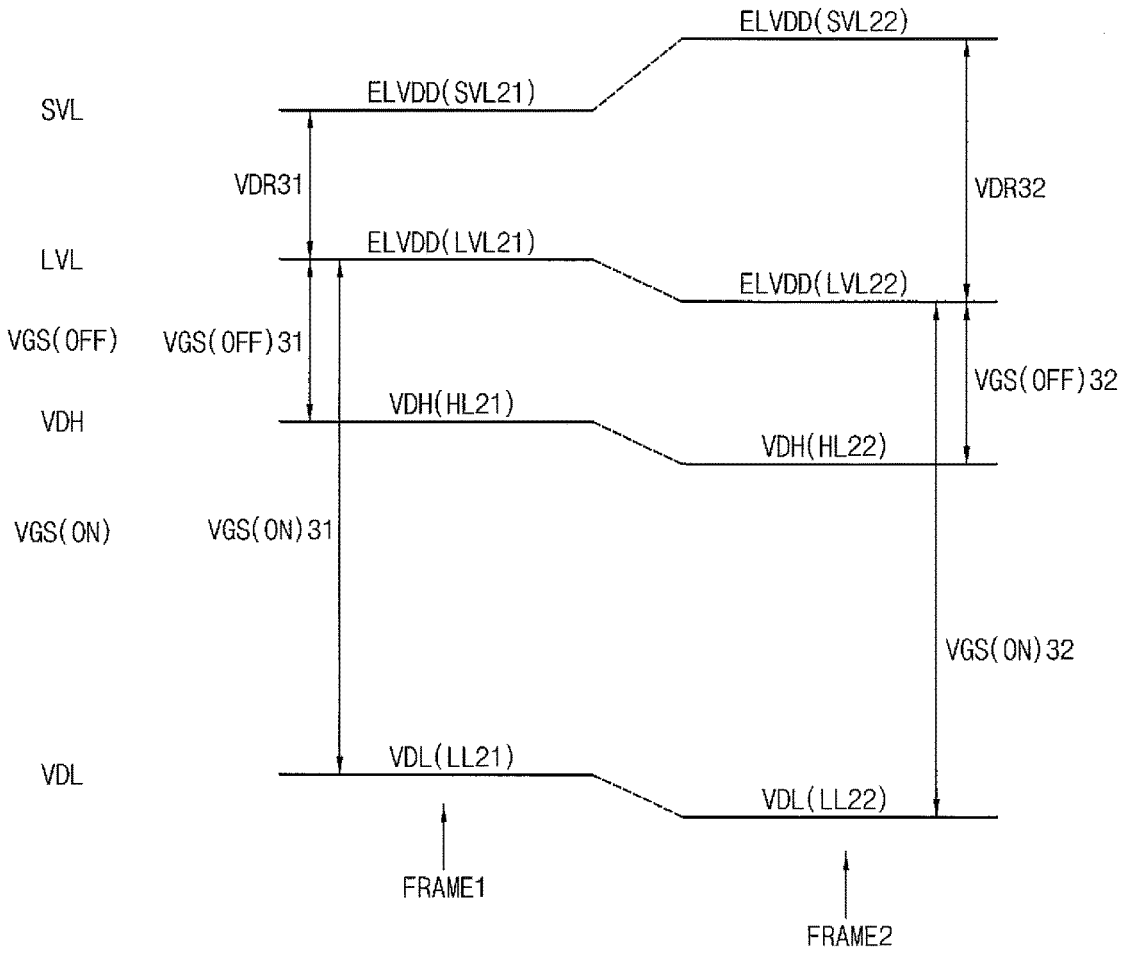

FIGS. 3A and 3B are diagrams for explaining a voltage control performed by an exemplary embodiment of a signal controller in the display device of FIG. 1.

Referring to FIGS. 3A and 3B, an input image data having a relatively low luminance may be displayed in a first frame FRAME1, and an input image data having a relatively high luminance may be displayed in a second frame FRAME2. A relation of voltages in a conventional display device where the high data voltage VDH and the low data voltage VDL are fixed is illustrated in FIG. 3A, and a relation of voltages in an exemplary embodiment of the invention where the high data voltage VDH and the low data voltage VDL are changed is illustrated in FIG. 3B.

Referring to FIGS. 2 and 3A, a supply voltage level SVL of the first power voltage ELVDD, which is supplied to the display panel 110, may be substantially constant regardless of a luminance of the input image data. Therefore, a second supply voltage level SVL12 in the second frame FRAME2 may be substantially the same as a first supply voltage level SVL11 in the first frame FRAME1.

Because an IR drop mainly occurs when the input image data corresponds to a higher luminance, a local voltage level LVL of the first power voltage ELVDD, which is supplied to the pixels 111, may be changed based on a luminance of the input image data. A second IR drop VDR12 in the second frame FRAME2 may be larger than a first IR drop VDR11 in the first frame FRAME1. Therefore, a second local voltage level LVL12 in the second frame FRAME2 may be lower than a first local voltage level LVL11 in the first frame FRAME1.

A local voltage level LVL of the first power voltage ELVDD may be supplied to the source electrode of the driving transistor M0 described in FIG. 2A. When the high data voltage VDH is supplied to the gate electrode of the driving transistor M0, the driving transistor M0 may be turned off. Here, a gate-source voltage VGS(OFF) of the driving transistor M0 which is turned off may correspond to a difference between a local voltage level LVL and the high data voltage VDH. When the low data voltage VDL is supplied to the gate electrode of the driving transistor M0, the driving transistor M0 may be turned on. Here, a gate-source voltage VGS(ON) of the driving transistor M0 which is turned on may correspond to a difference between a local voltage level LVL and the low data voltage VDL.

As described in FIG. 3A, the high data voltage VDH and the low data voltage VDL may be maintained at a constant level, respectively. That is, a voltage level HL11 of the high data voltage VDH in the first frame FRAME1 may be substantially the same as a voltage level HL12 of the high data voltage VDH in the second frame FRAME2, and a voltage level LL11 of the low data voltage VDL in the first frame FRAME1 may be substantially the same as a voltage level LL12 of the low data voltage VDL in the second frame FRAME2. Here, gate-source voltages VGS(OFF)11 and VGS(ON)11 in the first frame FRAME1 may be different from gate-source voltages VGS(OFF)12 and VGS(ON)12 in the second frame FRAME2.

Here, the high data voltage VDH and the low data voltage VDL is set with a predetermined margin, e.g., a margin enough to ensure a reliability of a switching operation (i.e., turning on and turning off) of the driving transistor M0. That is, the high data voltage VDH may be increased more than a predetermined level to allow or ensure a turn-on operation in a worst case (e.g., an IR drop is the biggest), and the low data voltage VDL may be decreased more than a predetermined level to allow or ensure a turn-off operation in the worst case.

Therefore, the high data voltage VDH and the low data voltage VDL may be set to be larger than a predetermined level, and a switching loss (i.e., driving power consumption) may be increased. A switching operation in a digital driving, in which the driving transistor M0 may be turned on or off in every sub frame, may occur more frequently than an analog driving. Therefore, the switching loss may be increased. Also, as a difference between the high data voltage VDH and the low data voltage VDL is increased, a driving loss by a switching operation of the driving transistor M0 may be substantially increased.

Referring to FIG. 3B, in an exemplary embodiment, the supply voltage level SVL of the first power voltage ELVDD may be changed based on a luminance of the input image data. Therefore, a second supply voltage level SVL22 in the second frame FRAME2 may be higher than a first supply voltage level SVL21 in the first frame FRAME1.

As described above with reference to FIG. 3A, because a second IR drop VDR22 in the second frame FRAME2 is larger than a first IR drop VDR21 in the first frame FRAME1, a second local voltage level LVL22 in the second frame FRAME2 may be lower than a first local voltage level LVL21 in the first frame FRAME1. In an exemplary embodiment, as shown in FIG. 3B, the second supply voltage level SVL22 of the first power voltage ELVDD in the second frame FRAME2 may be set to be more higher, such that the second local voltage level LVL22 in the second frame FRAME2 may be higher than the first local voltage level LVL21 in the first frame FRAME1.

In an exemplary embodiment, the high data voltage VDH and the low data voltage VDL may be controlled by the signal controller 150. Therefore, a voltage level HL22 of the high data voltage VDH in the second frame FRAME2 may be lower than a voltage level HL21 of the high data voltage VDH in the first frame FRAME1, and a voltage level LL22 of the low data voltage VDL in the second frame FRAME2 may be lower than a voltage level LL21 of the low data voltage VDL in the first frame FRAME1. Here, gate-source voltages VGS(OFF)31 and VGS(ON)31 in the first frame FRAME1 and gate-source voltages VGS(OFF)32 and VGS(ON)32 may be kept constant or maintained at a constant level, regardless of a luminance of the input image data.

Because the gate-source voltage Vgs is maintained or kept substantially constant when the driving transistor M0 is turned on or off, the high data voltage VDH and the low data voltage VDL may be set lower than those in FIG. 3A without considering a margin for the worst case. Therefore, in such an embodiment, a driving loss of a switching operation may be decreased by decreasing a difference between the high data voltage VDH and the low data voltage VDL.

The configuration of an exemplary embodiment of the signal controller 150 will now be described with reference to FIGS. 4 and 5.

Figure 4:
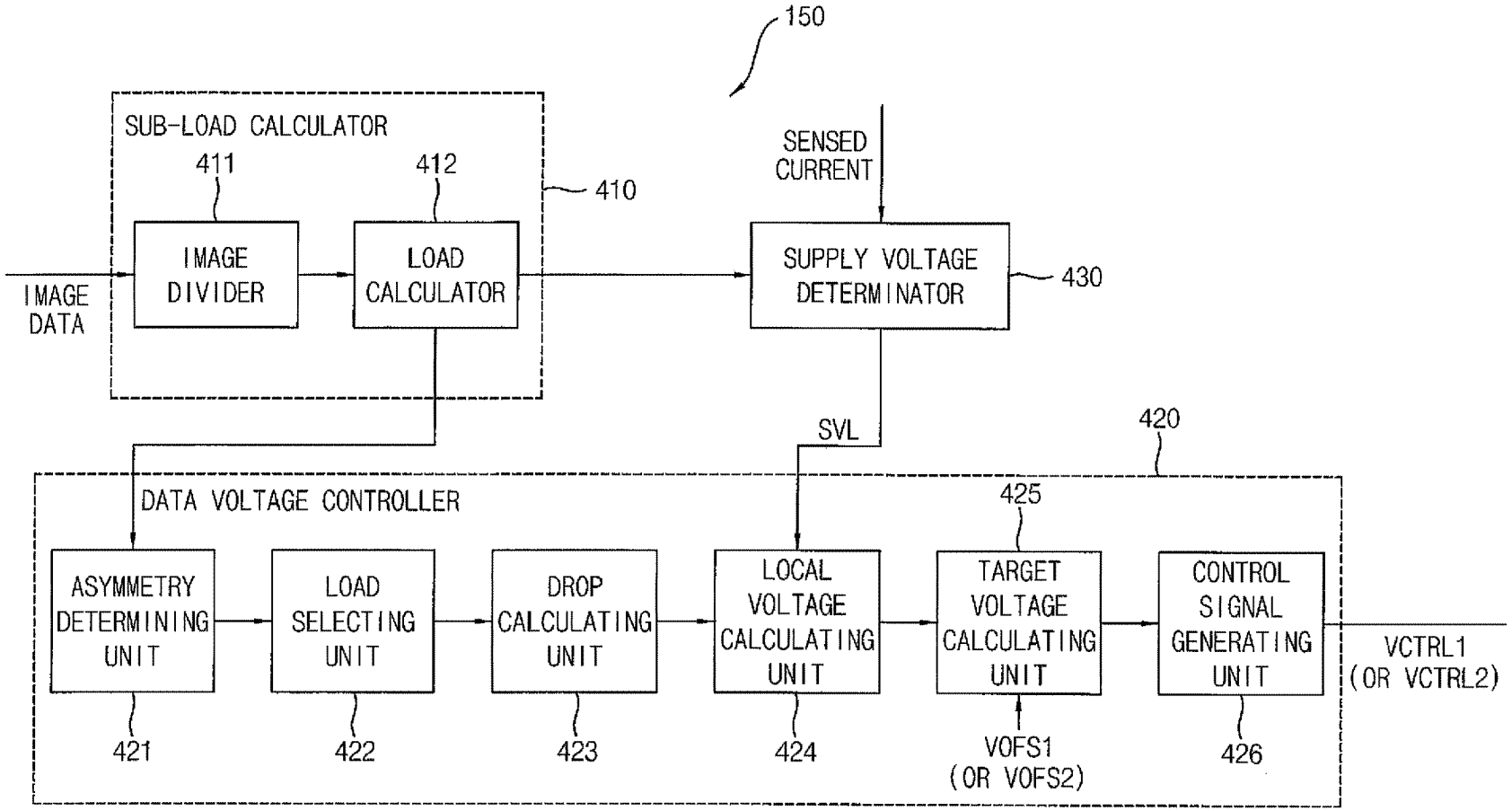
FIG. 4 is a block diagram illustrating an exemplary embodiment of a signal controller in the display device of FIG. 1.

FIG. 4 is a block diagram illustrating an exemplary embodiment of a signal controller in the display device of FIG. 1.

Referring to FIGS. 1 and 4, an exemplary embodiment of the signal controller 150 may include a sub-load calculator 410 that calculates a sub-loads corresponding to each of a plurality of sub-image data, and a data voltage controller 420 that adjusts at least one of the high data voltage VDH and the low data voltage VDL, which are supplied to the display panel 110 by analyzing each of the sub-loads. In such an embodiment, the sub-image data may include at least a portion of the input image data IMAGE DATA. The signal controller 150 may further include a supply voltage determinator 430 that determines the supply voltage level SVL of the first power voltage ELVDD, which is supplied to the display panel 110.

The sub-load calculator 410 may include an image divider 411 that generates a plurality of sub-image data by dividing the input image data IMAGE DATA and a load calculator 412 that calculates a sub-load of each of the sub-image data.

The image divider 411 may divide the input image data IMAGE DATA. The image divider 411 may generate a plurality of sub-image data by dividing the input image data IMAGE DATA into the plurality of sub-image data corresponding to a plurality of blocks of the display panel, respectively.

In one exemplary embodiment, for example, the image divider 411 may divide the input image data IMAGE DATA into M×N blocks which do not overlap (here, M and N are natural numbers). In an alternative exemplary embodiment, the image divider 411 may divide the input image data IMAGE DATA into two blocks which are divided into a left block and a right block by a vertical axis which passes through a center of the input image data IMAGE DATA. Here, sizes (or area) of blocks may be substantially the same as or different from each other.

In one alternative exemplary embodiment, for example, the image divider 411 may generate sub-image data corresponding to some portions of the input image data IMAGE DATA and an entire portion of the input image data IMAGE DATA. In such an embodiment, the sub-image data may overlap from each other.

In one exemplary embodiment, for example, the display device 100 includes a plurality of driving integrated circuits, and the image divider 411 may divide the input image data IMAGE DATA based on a plurality of blocks corresponding to the integrated circuits, respectively.

In one exemplary embodiment, for example, when the input image data IMAGE DATA is in a RGB format, the image divider 411 may divide the input image data IMAGE DATA based on colors thereof.

In one exemplary embodiment, for example, the image divider 411 may divide the input image data IMAGE DATA using a combination of methods described above.

The load calculator 412 may calculate average grayscales of each of the sub-image data. In one exemplary embodiment, for example, the load calculator 412 may calculate an average grayscale using an arithmetic mean of grayscales included in the sub-image data. In one exemplary embodiment, for example, the load calculator 412 may calculate a luminance of each of the sub-image data using an arithmetic mean of luminance corresponding to grayscales included in the sub-image data, and may calculate an average grayscale based on the luminance.

The load calculator 412 may calculate a sub-load based on the average grayscale. In one exemplary embodiment, for example, the load calculator 412 may calculate a sub-load corresponding to the average grayscale using a look-up table. In one exemplary embodiment, for example, the load calculator 412 may determine the average grayscale as the sub-load.

The data voltage controller 420 may include an asymmetry determining unit 421 that calculates an asymmetry of the sub-loads, a load selecting unit 422 that selects one sub-load based on a result of the determining unit 421, a drop calculating unit 423 that calculates an IR drop of the first power voltage ELVDD, a local voltage calculating unit 424 that calculates the local voltage level LVL of the first power voltage ELVDD by subtracting the IR drop from the supply voltage level SVL, a target voltage calculating unit 425 that calculates a target voltage level by subtracting an offset voltage from the local voltage level LVL, and a control signal generating unit 426 that controls data voltages VDH and VDL.

The asymmetry determining unit 421 may calculate asymmetry (or, a skewness) of the sub-loads. Here, asymmetry represents a degree of an asymmetry of an average of the sub-loads. In one exemplary embodiment, for example, the asymmetry determining unit 421 may calculate asymmetry by using a Pearson's skewness coefficient. The asymmetry determining unit 421 may calculate asymmetry based on or considering a size (e.g., sizes of divided blocks) of the sub-image data.

The load selecting unit 422 may determine whether the asymmetry is within a specified range (e.g., a predetermined range), and may select one sub-load among the sub-loads based on a determination result. In an exemplary embodiment, the asymmetry may be expressed in a value.

In an exemplary embodiment, when the asymmetry is within a specified range, the load selecting unit 422 may select a minimum sub-load among the sub-loads. In such an embodiment, the minimum sub-load may be used to control the high data voltage VDH. In one exemplary embodiment, for example, when the asymmetry calculated by the asymmetry determining unit 421 is 20, and the specified range is a value of 10 or greater, the load selecting unit 422 may select a sub-load having the smallest size as a minimum sub-load.

In an exemplary embodiment, when the asymmetry is within a specified range, the load selecting unit 422 may select a maximum sub-load among the sub-loads. In such an embodiment, the maximum sub-load may be used to control the low data voltage VDL. In one exemplary embodiment, for example, when the asymmetry which is calculated by the asymmetry determining unit 421 is 20, and the specified range is a value of 10 or greater, the load selecting unit 422 may select a sub-load having the biggest size as a maximum sub-load.

In an exemplary embodiment, when the asymmetry is out of the specified range, the load selecting unit 422 may select an average sub-load, which has an average value of the sub-loads. In such an embodiment, the average sub-load may be used to control the high data voltage VDH and the low data voltage VDL. In such an embodiment, the average sub-load may be calculated by an arithmetic mean of the sub-loads or may be supplied from the load calculating unit 421.

In an exemplary embodiment, the drop calculating unit 423 may calculate an IR drop VDR of the first power voltage ELVDD based on a load of the display panel 110. In such an embodiment, the load may be a total load of the display panel 110 or may be a load selected by the load selecting unit 422. In one exemplary embodiment, for example, the drop calculating unit 423 may calculate an IR drop based on a total load of the display panel 110 and may compensate the IR drop based on a sub-load which is selected. In such an embodiment, the load selecting unit 423 may calculate the IR drop by selecting an IR drop corresponding to the load in look-up table.

In an exemplary embodiment, the drop calculating unit 423 may calculate a first IR drop VDR1 based on the minimum sub-load. In such an embodiment, the first IR drop VDR1 may be used to control the high data voltage VDH. In an exemplary embodiment, the drop calculating unit 423 may calculate a second IR drop VDR2 based on the maximum sub-load. In such an embodiment, the second IR drop VDR2 may be used to control the low data voltage VDL.

In an exemplary embodiment, the drop calculating unit 423 may calculate an IR drop VDR of the first power voltage ELVDD based on a sensed current signal. In such an embodiment, the sensed current signal may be a global current GI which is measured at a first power voltage output terminal of the power supplier 160. The drop calculating unit 423 may calculate an IR drop VDR as a multiplied value (e.g., GI×Rp) which is acquired by multiplying the global current GI by a resistance Rp of a supply path of the first power voltage ELVDD. In such an embodiment, the supply path and the resistance Rp may be determined by some criteria. In one exemplary embodiment, for example, the supply path may be determined a path from the power supplier 160 to a point in which the global current GI is divided into cell driving currents which flow to pixels 111, and the resistance Rp for calculating the IR drop VDR may be a parasitic resistance of the path. In one exemplary embodiment, for example, the first power voltage ELVDD may be supplied to a center of the display panel 110, and cell driving currents may be sequentially divided from the center to an outside of the display panel 110. Here, the resistance Rp for calculating the IR drop VDR may be determined as a parasitic resistance from the power supplier 160 to the center of the display panel 110.

The local voltage calculating unit 424 may calculate the local voltage level LVL of the first power voltage ELVDD as a subtracted value (i.e., SVL−VDR) which is acquired by subtracting the IR drop VDR from the supply voltage level SVL. Here, the supply voltage level SVL may be a voltage level which is supplied from the power supplier 160, and the supply voltage level SVL may be determined by the power voltage determinator 430.

In an exemplary embodiment, the local voltage calculating unit 424 may calculate a first local voltage level LVL1 of the first power voltage ELVDD as a subtracted value (i.e., SVL−VDR1) which is acquired by subtracting a first IR drop VDR1 from the supply voltage level SVL. Here, the first local voltage level LVL1 may be used to control the high data voltage VDH. In an exemplary embodiment, the local voltage calculating unit 424 may calculate a second local voltage level LVL2 of the first power voltage ELVDD as a subtracted value (i.e., SVL−VDR2) which is acquired by subtracting a second IR drop VDR1 from the supply voltage level SVL. Here, the second local voltage level LVL2 may be used to control the low data voltage VDL.

The target voltage calculating unit 425 may calculate a first target voltage level TVL1 as a subtracted value (i.e., LVL−VOFS1) which is acquired by subtracting a first offset voltage VOFS1 from the local voltage level LVL. The target voltage calculating unit 425 may calculate a second target voltage level TVL2 as a subtracted value (i.e., LVL−VOFS2) which is acquired by subtracting a second offset voltage VOFS2, which is higher than the first offset VOFS1, from the local voltage level LVL. Here, the first offset voltage VOFS1 is corresponding to a gate-source voltage (VGS(OFF)) of the driving transistor M0 which is turned off shown in FIG. 2, and the second offset voltage VOFS2 is corresponding to a gate-source voltage (VGS(ON)) of the driving transistor M0 which is turned on.

In an exemplary embodiment, the target voltage calculating unit 425 may calculate a first target voltage level TVL1 as a subtracted value (i.e., LVL1−VOFS1) which is acquired by subtracting a first offset voltage VOFS1 from the first local voltage level LVL1. Here, the first target voltage level TVL1 may be used to control the high data voltage VDH. The target voltage calculating unit 425 may calculate a second target voltage level TVL2 as a subtracted value (i.e., LVL2−VOFS2) which is acquired by subtracting a second offset voltage VOFS2, which is higher than the first offset VOFS1, from the second local voltage level LVL2. Here, the second target voltage level TVL2 may be used to control the low data voltage VDL.

The control signal generating unit 426 may generate a first voltage control signal VCTRL1 and a second voltage control signal VCTRL2 based on the first target voltage level TVL1 and the second target voltage level TVL2. The first target voltage level TVL1 or the second target voltage level TVL2 may be included in the voltage control signal VCTRL shown in FIG. 1.

The supply voltage determinator 430 may determine the supply voltage level SVL of the first power voltage ELVDD. In an exemplary embodiment, the supply voltage determinator 430 may sense a supplied voltage level of the first power voltage ELVDD supplied to the display panel 110, and may determine the supply voltage level SVL as the sensed supplied voltage level. In an exemplary embodiment, the supply voltage determinator 430 may calculate a supplied voltage level of the first power voltage ELVDD supplied to the display panel based on the input image data, and determine the supply voltage level SVL as the calculated supplied voltage level. In an exemplary embodiment, the supply voltage determinator 430 may determine the supply voltage level SVL as a big one selected by comparing the supplied voltage level which is sensed and the supplied voltage level which is calculated.

In such an embodiment, the power supplier 160 may generate the high data voltage VDH based on the first voltage control signal VCTRL1 and may generate the low data voltage VDL based on the second voltage control signal VCTRL2.

Figure 5A:
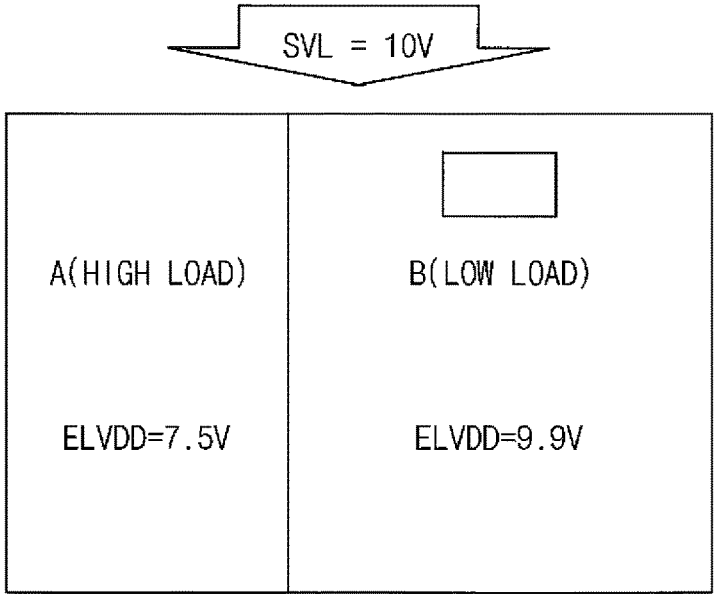
FIGS. 5A through 5C are diagrams for explaining a voltage control by the signal controller of FIG. 4.
Figure 5B:
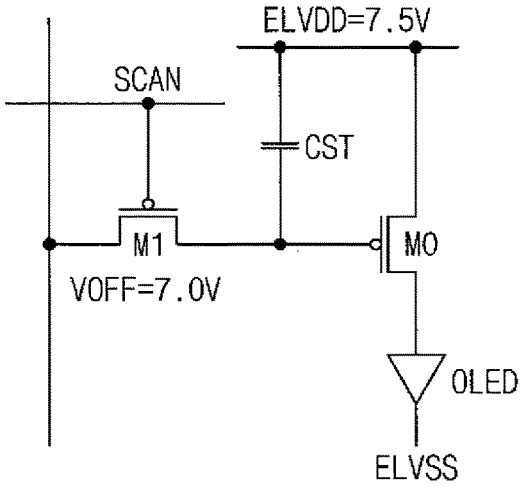
Figure 5C:
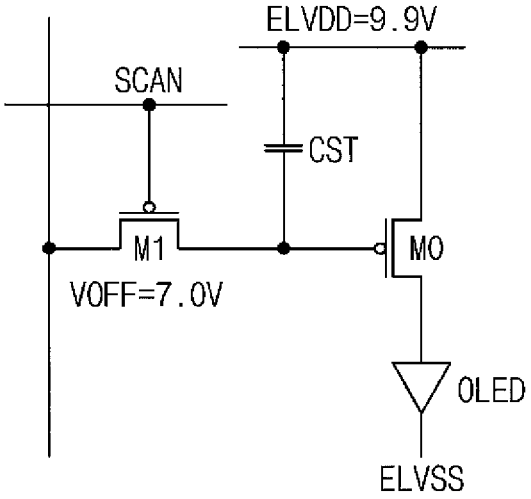

FIGS. 5A through 5C are diagrams for explaining a voltage control by the signal controller of FIG. 4.

Referring to FIG. 5A, in an exemplary embodiment, an input image data includes two sub-image data A and B which are divided by a vertical axis. A size of a first sub-image data A may be smaller than that of a second sub-image data B. The first sub-image data A may have a high luminance, and the second sub-image data B may have a low luminance except some portions thereof.

A sub-load of the first sub-image data A may be calculated higher than that of the second sub-image B. Due to a high sub-load of the first sub-image data A, an IR drop corresponding thereto may be large. In one exemplary embodiment, for example, the first power voltage ELVDD in one portion of the display panel 110 in which the first sub-image data A is displayed may be about 7.5 volts (V). Due to a low sub-load of the second sub-image data B, an IR drop corresponding thereto may be small. In one exemplary embodiment, for example, the first power voltage ELVDD in the other portion of the display panel 110 in which the second sub-image data B is displayed may be about 9.9 V.

The pixel circuits described in FIGS. 5B and 5C may be substantially the same as a pixel circuit described in FIG. 2A. A high data voltage VDH (or, V_OFF) may be about 7.0 V which is calculated based on a total load.

In FIG. 5B, a pixel circuit that receives the first sub-image data A (or a pixel circuit in a block A) shown in FIG. 5A is illustrated. In the pixel circuit of FIG. 5B, the first power voltage ELVDD supplied to a first electrode (or a source electrode) of a driving transistor M0 may be about 7.5 V, and the high data voltage V_OFF supplied to a gate electrode of the driving transistor M0 may be about 7.0 V. Therefore, a gate-source voltage of the driving transistor M0 may be about −0.5 V. Corresponding to a current-voltage ("IV") characteristic of the driving transistor M0 shown in FIG. 2B, the driving transistor M0 may be turned off.

In FIG. 5C, a pixel circuit that receives the second sub-image data B (or a pixel circuit in a block B) shown in FIG. 5A is illustrated. The first power voltage ELVDD which is supplied to a first electrode (or, a source electrode) of a driving transistor M0 may be about 9.9 V, and the high data voltage V_OFF which is supplied to a gate electrode of the driving transistor M0 may be about 7.0 V. Therefore, a gate-source voltage of the driving transistor M0 may be about −2.9 V. Corresponding to an IV characteristic of the driving transistor M0 shown in FIG. 2B, the driving transistor M0 may be operated in a linear area. Therefore, the driving transistor M0 may not be turned off corresponding to the high data voltage V_OFF, and a leakage current may flow through an organic light emitting diode OLED.

If a low data voltage VDL (or V_ON) is controlled based on a total load of the input image data, a gate-source voltage of the driving transistor M0, which corresponds to the first sub-image data A having a relatively low load, may be a relatively low. That is, the driving transistor M0 may be operated in a linear area, not in a saturation area, and a current lower than a driving current in a turn-on state may flow through the organic light emitting diode OLED. Therefore, the organic light emitting diode OLED may emit light with a relatively low luminance.

If a high data voltage V_OFF is controlled based on a total load of the input image data, a leakage failure may occur in a portion which has a relatively low load in accordance with an asymmetry of an input image data, and a luminance may be lower in a portion which has a relatively high load (i.e., image degradation occurs). Also, when data voltages V_OFF and VON are set to have an enough margin, a driving power consumption of the display device 100 may be substantially increased.

In an exemplary embodiment, the display device 100 may control the data voltages V_OFF and V_ON in consideration of a load asymmetry of the input image data. Therefore, in such an embodiment, the display device 100 may effectively prevent image degradation due to a leakage failure, and effectively prevent a driving consumption power from being increased.

Figure 6:
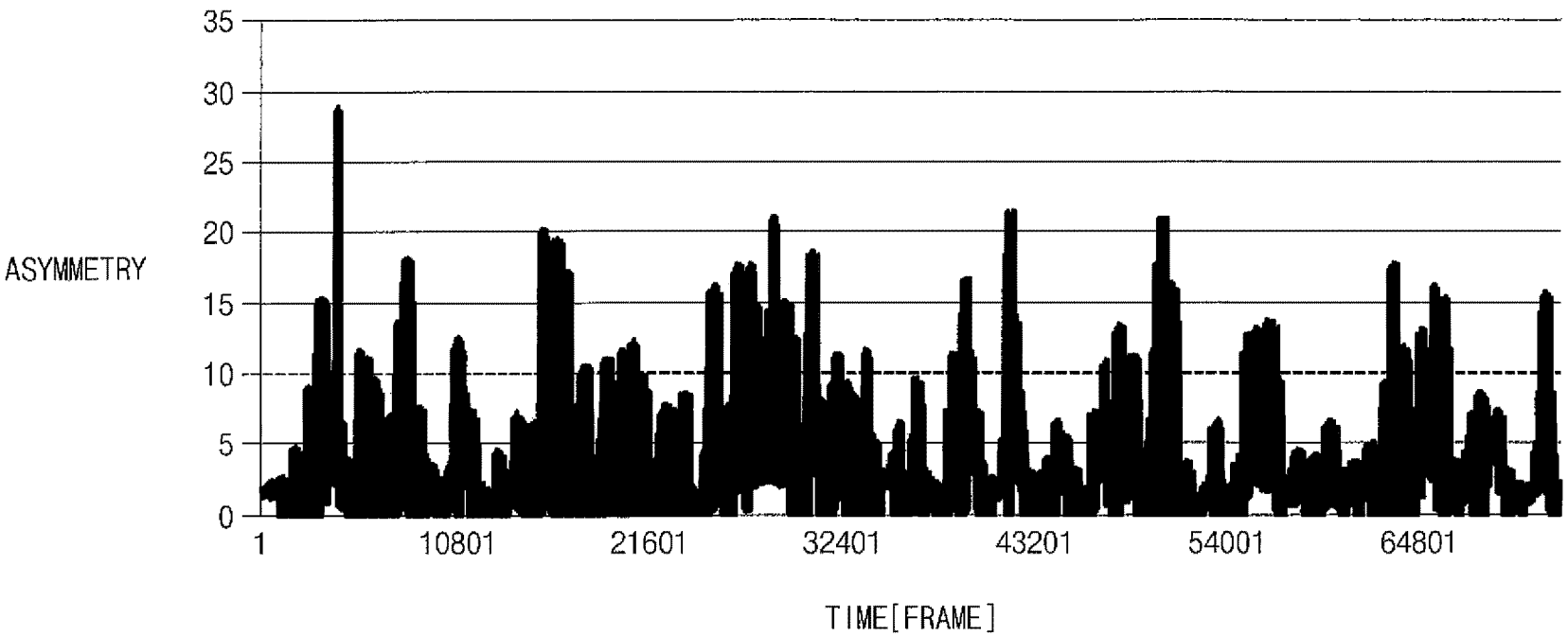
FIG. 6 is a graph illustrating an asymmetry of an input image data calculated by the signal controller of FIG. 4.

FIG. 6 is a graph illustrating an asymmetry of an input image data calculated by the signal controller of FIG. 4. In FIG. 6, a load asymmetry of R image data among image data of a public broadcasting which has a RGB format is described.

Referring to FIG. 6, an X axis represents a time (or a frame), and a Y axis represents an asymmetry. A level of the asymmetry may be constantly changed in time.

As described above with reference to FIG. 4, an exemplary embodiment of the display device 100 may control the data voltages VDH and VDL based on whether the asymmetry is within a specified range. In one exemplary embodiment, for example, when the asymmetry is lower than 10, the display device 100 may determine the data voltages VDH and VDL based on a total load of the input image data. In one exemplary embodiment, for example, when the asymmetry is higher than 10, the display device 100 may determine the data voltages VDH and VDL based on any sub-load of the input image data.

Figure 7:
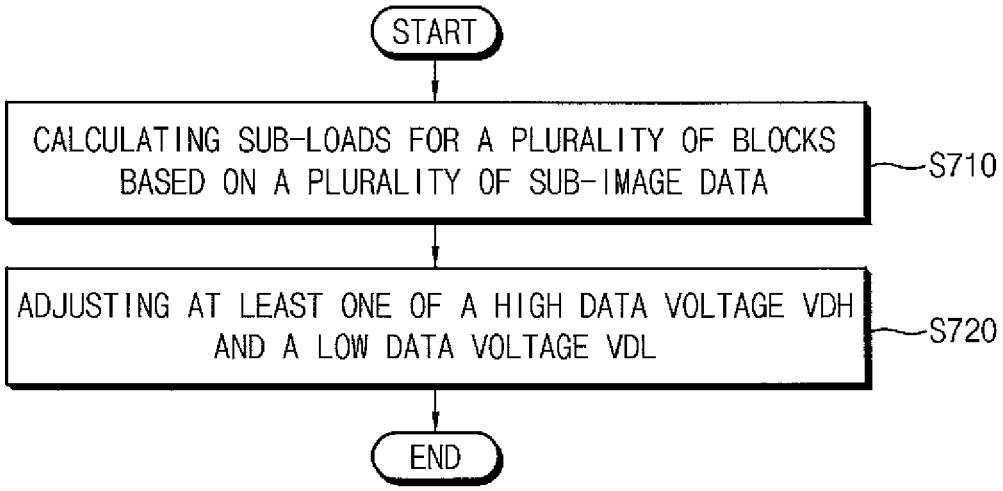
FIG. 7 is a flow chart illustrating an exemplary embodiment of a method of driving the display device of FIG. 1.

FIG. 7 is a flow chart illustrating an exemplary embodiment of a method of driving the display device of FIG. 1.

Referring to FIGS. 1 and 7, in an exemplary embodiment, the display device 100 may calculate a sub-load corresponding to each of a plurality of sub-image data (S710). In such an embodiment, the sub-image data may have at least a portion of an input image data which is supplied to the display panel 110.

In one exemplary embodiment, for example, the display device 100 may divide the input image data into n (here, n is an integer of 2 or greater) sub-image data corresponding to n blocks and may calculate sub-loads based on the sub-image data, respectively.

In an exemplary embodiment, the display device 100 may adjust at least one of the high data voltage VDH and the low data voltage VDL by analyzing each of the sub-loads (S720).

In one exemplary embodiment, for example, the display device 100 may calculate an asymmetry of the sub-loads and may control the high data voltage VDH based on the asymmetry when the asymmetry is higher than a specific level.

Figure 8:
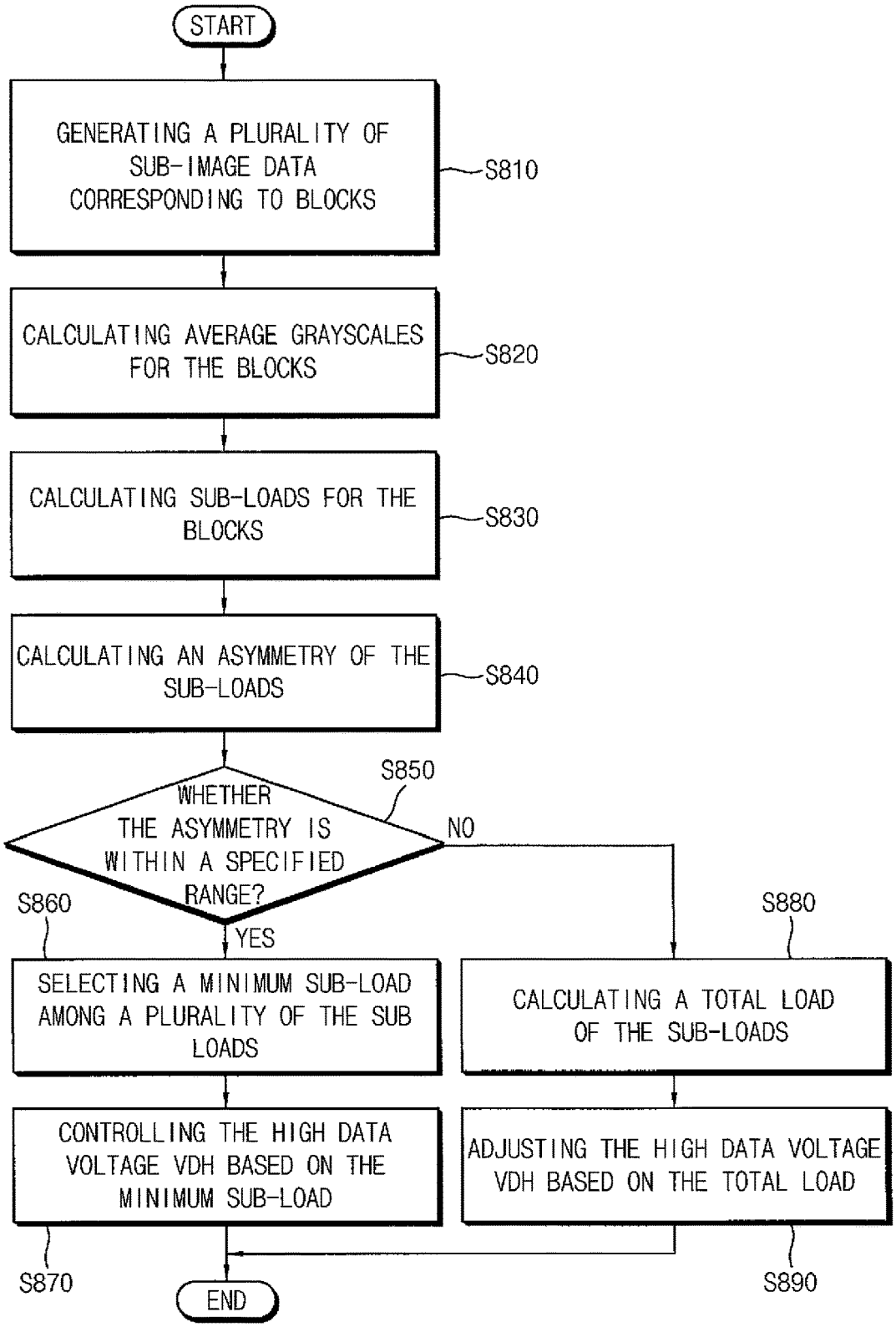
FIG. 8 is a flow chart illustrating an alternative exemplary embodiment of a method of driving the display device of FIG. 1.

FIG. 8 is a flow chart illustrating an alternative exemplary embodiment of a method of driving the display device of FIG. 1.

Referring to FIGS. 1 and 8, in an exemplary embodiment, the display device 100 may generate a plurality of sub-image data by dividing the input image data into predetermined blocks (S810). In such an embodiment, the display device 100 may generate a plurality of sub-image data by dividing an input image data supplied to a display panel into the plurality of sub-image data corresponding to a plurality of blocks of the display panel, respectively. A size of each of the predetermined blocks may be the same as or different from each other.

In an exemplary embodiment, the display device 100 may calculate average grayscales for the plurality of blocks based on the plurality of sub-image data, respectively (S820). In one exemplary embodiment, for example, the display device 100 may calculate the average grayscales using an arithmetic mean of grayscales included in the sub-image data, respectively.

In an exemplary embodiment, the display device 100 may calculate sub-loads for the plurality of blocks based on the average grayscales (S830), and may calculate an asymmetry of the sub-loads (S840).

In an exemplary embodiment, the display device 100 may determine whether the asymmetry which is calculated is within a specified range (S850). If the asymmetry is within the specified range, the display device 100 may select a minimum sub-load which has the smallest load among a plurality of the sub-loads (S860). In such an embodiment, the display device 100 may control the high data voltage VDH based on the minimum sub-load which is selected (S870). In one exemplary embodiment, for example, the display device may determine whether the asymmetry is higher than 10. If the asymmetry is higher than 10, the display device 100 select a minimum sub-load (or a sub-image data) which has the smallest load, and the display device 100 may adjust the high data voltage VDH based on the selected minimum sub-load.

In such an embodiment, if the asymmetry is within the specified range, the display device 100 may select a maximum load which has the biggest load among a plurality of the sub-loads. The display device 100 may adjust the low data voltage VDL based on the selected maximum sub-load.

In such an embodiment, if the asymmetry is out of the specified range, the display device 100 may calculate a total load of the sub-loads (S880), and may adjust the high data voltage VDH based on the total load (S890).

Figure 9:
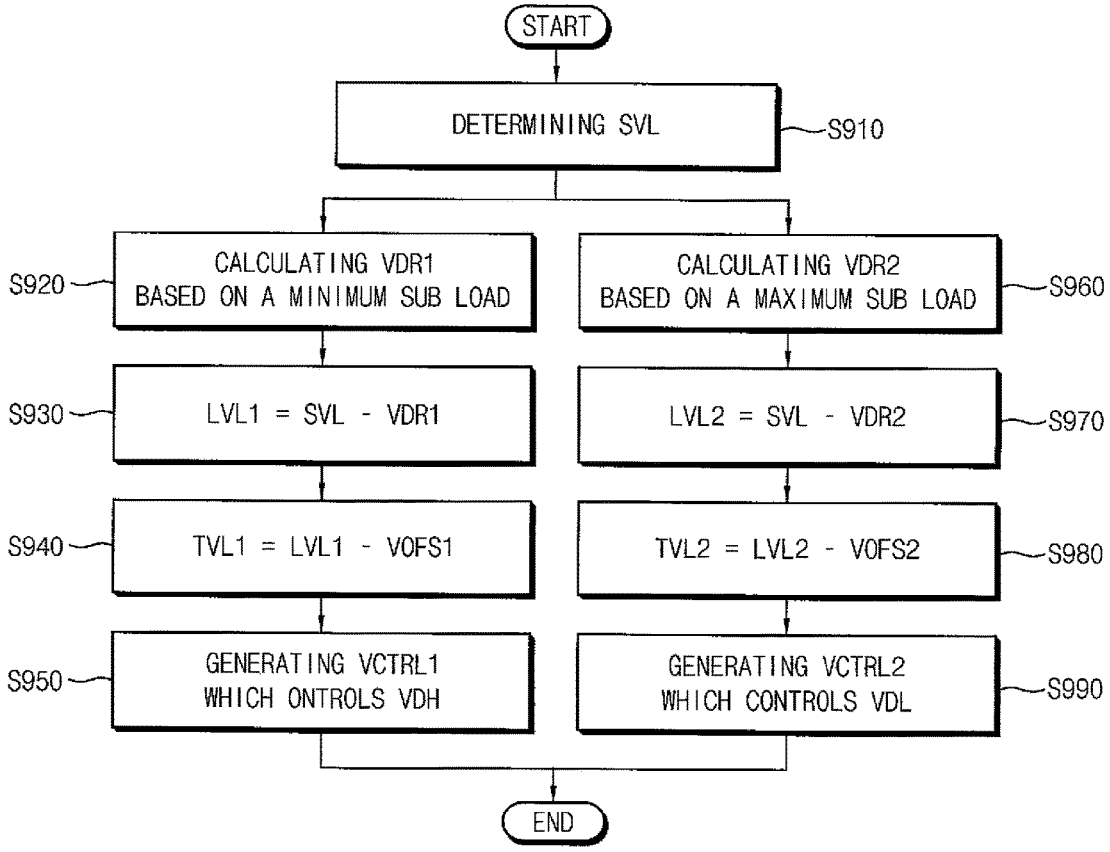
FIG. 9 is a flow chart illustrating a process of adjusting data voltages in an exemplary embodiment of the method of driving the display device of FIG. 8.

FIG. 9 is a flow chart illustrating a process of adjusting data voltages in an exemplary embodiment of the method of driving the display device of FIG. 8. Adjusting data voltages may be performed after an asymmetry of the input image data is determined.

Referring to FIGS. 1, 4 and 9, in an exemplary embodiment, the display device 100 may determine the supply voltage level SVL of the first power voltage ELVDD, which is supplied to the display panel 110 (S910).

The display device 100 may determine the supply voltage level SVL of the first power voltage ELVDD base on the input image data, a first power voltage ELVDD which is measured, or a combination thereof.

The display device 100 may adjust the high data voltage VDH and the low data voltage VDL sequentially or simultaneously.

The display device 100 may calculate a first IR drop VDR1 of the first power voltage ELVDD based on a minimum sub-load (S920). In one exemplary embodiment, for example, the display device 100 may obtain the first IR drop corresponding to the minimum sub-load by using a look-up table. In one alternative exemplary embodiment, for example, the display device 100 may calculate a IR drop of the first power voltage ELVDD based on a global current, which is measured, and may calculated the first IR drop by compensating the IR drop based on the minimum sub-load.

The display device 100 may calculate a first local voltage level LVL1 of the first power voltage ELVDD by subtracting the first IR drop VDR1 from the supply voltage level SVL (S930). The display device 100 may calculate a first target voltage level TVL1 by subtracting a first offset voltage VOFS1 from the first local voltage level LVL1 (S940). The display device 100 may generate a first voltage control signal VCTRL1, which controls the high data voltage VDH, based on the first target voltage level TVL1 (S950).

In such an embodiment, the display device 100 may calculate a second IR drop VDR2 of the first power voltage ELVDD based on a maximum sub-load (S960).

The display device 100 may calculate a second local voltage level LVL2 of the first power voltage ELVDD by subtracting the second IR drop VDR2 from the supply voltage level SVL (S970). The display device 100 may calculate a second target voltage level TVL2 by subtracting a second offset voltage VOFS2 from the second local voltage level LVL2 (S980). The display device 100 may generate a second voltage control signal VCTRL2, which controls the low data voltage VDL, based on the second target voltage level TVL2 (S990).

Figure 10:
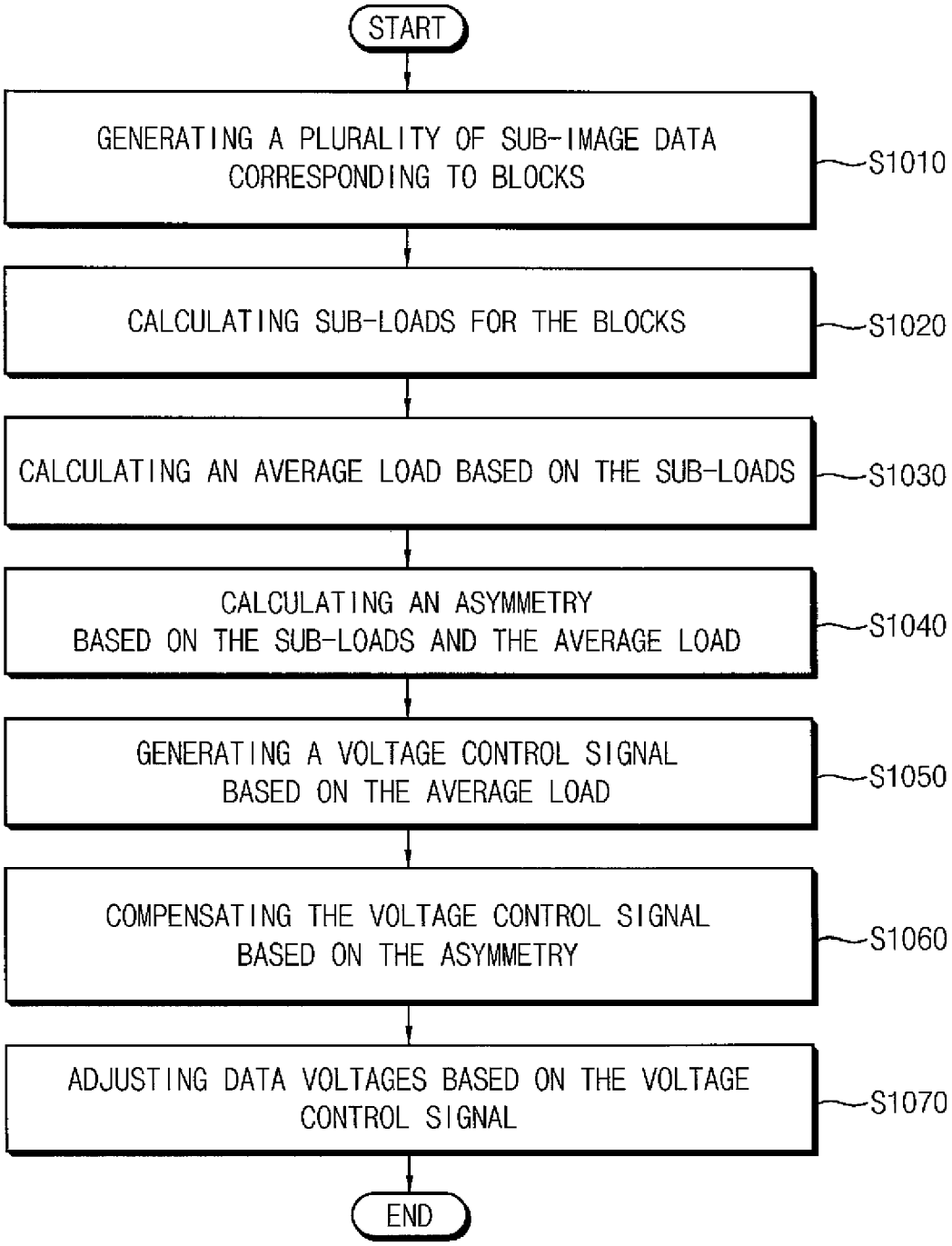
FIG. 10 is a flow chart illustrating another alternative exemplary embodiment of a method of driving the display device of FIG. 1.

FIG. 10 is a flow chart illustrating an alternative exemplary embodiment of a method of driving the display device of FIG. 1.

Referring to FIGS. 1 and 10, in an exemplary embodiment, the display device 100 may calculate an average load and an asymmetry by analyzing the input image data. In an exemplary embodiment, the display device 100 may generate a plurality of sub-image data by dividing the input image data into the plurality of sub-image data respectively corresponding to a plurality of blocks of the display panel (S1010). The display device 100 may calculate sub-loads for the plurality of blocks based on the plurality of sub-image data, respectively (S1020). The display device 100 may calculate the average load based on the sub-loads (S1030). The display device 100 may calculate the asymmetry based on the sub-loads and the average load, which are calculated (S1040).

The display device 100 may adjust at least one of the high data voltage VDH and the low data voltage VDL, which are supplied to the display panel 110, based on the average load and the asymmetry. In an exemplary embodiment, the display device 100 may generate a voltage control signal which adjusts at least one of the high data voltage VDH and the low data voltage VDL based on the average load (S1050). The display device 100 may compensate the voltage control signal based on the asymmetry (S1060). In one exemplary embodiment, for example, when the asymmetry is within a specified range, the display device 100 may compensate the voltage control signal based on some sub-loads. In one exemplary embodiment, for example, when the asymmetry is out of a specified range, the display device may not compensate the voltage control signal.

The configuration of generating the target voltage control signal may be substantially the same as to or similar to a process of generating a voltage control signal described above with reference to FIG. 9.

The display device 100 may adjust the high data voltage VDH and the low data voltage VDL based on the voltage control signal (S1070).

According to exemplary embodiments, the method of driving a display device may adjust data voltages VDH and VDL based on a load asymmetry of an input image data. Therefore, the method may effectively prevent image degradation due to a leakage failure, and effectively prevent a driving consumption power from being increased.

Exemplary embodiments described herein may be applied to any display device having a display panel. In one exemplary embodiment, for example, exemplary embodiments of the invention may be applied to an organic light emitting display device and a liquid crystal display device, or it may be applied to a television, a computer monitor, a laptop, a digital camera, a cellular phone, a smart phone, a personal digital assistant ("PDA"), a portable multimedia player ("PMP"), a MP3 player, a navigation system, a video phone, etc.

The foregoing is illustrative of exemplary embodiments, and is not to be construed as limiting thereof. Although a few exemplary embodiments have been described, those skilled in the art will readily appreciate that many modifications are possible in the exemplary embodiments without materially departing from the novel teachings and advantages of exemplary embodiments. Accordingly, all such modifications are intended to be included within the scope of exemplary embodiments as defined in the claims. In the claims, means-plus-function clauses are intended to cover the structures described herein as performing the recited function and not only structural equivalents but also equivalent structures. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A method of driving a display device, the method comprising:

generating a plurality of sub-image data by dividing an input image data supplied to a display panel of the display device into the plurality of sub-image data corresponding to a plurality of blocks of the display panel, respectively;

calculating sub-loads for the plurality of blocks based on the plurality of sub-image data, respectively; and adjusting at least one of a high data voltage and a low data voltage, which are supplied to a driving transistor included in a pixel of the display panel, by analyzing the sub-loads, wherein the adjusting the at least one of the high data voltage and the low data voltage comprises:

calculating an asymmetry of the input image data based on the sub-loads; and generating a voltage control signal, which changes at least one of the high data voltage and the low data voltage, based on the sub-loads and the asymmetry, and wherein the generating the voltage control signal comprises:

determining a supply voltage level of a first power voltage which is supplied to the display panel;

calculating a first current-resistance drop of the first power voltage by analyzing the sub-loads;

calculating a first local voltage level of the first power voltage by subtracting the first current-resistance drop from the supply voltage level;

calculating a first target voltage level by subtracting a first offset voltage from the first local voltage level; and generating the voltage control signal based on the first target voltage level, wherein the voltage control signal adjusts the high data voltage.

2. The method of claim 1, wherein the high data voltage is a data voltage for turning off the driving transistor included in the pixel of the display panel, and the low data voltage is a data voltage for turning on the driving transistor.

3. The method of claim 1, wherein the calculating the sub-loads comprises:

calculating average grayscales for the plurality of blocks based on the plurality of sub-image data, respectively; and calculating the sub-loads based on the average grayscales, respectively.

4. The method of claim 1, wherein the first current-resistance drop of the first power voltage is calculated based on a minimum sub-load of the sub-loads.

5. The method of claim 1, wherein the driving transistor included in the pixel of the display panel is turned off in response to the high data voltage, and the first offset voltage has a substantially constant level determined based on a gate-source voltage of the turned-off driving transistor.

6. A method of driving a display device, the method comprising: generating a plurality of sub-image data by dividing an input image data supplied to a display panel of the display device into the plurality of sub-image data corresponding to a plurality of blocks of the display panel, respectively; calculating sub-loads for the plurality of blocks based on the plurality of sub-image data, respectively; and adjusting at least one of a high data voltage and a low data voltage, which are supplied to a driving transistor included in a pixel of the display panel, by analyzing the sub-loads, wherein the adjusting the at least one of the high data voltage and the low data voltage comprises: calculating an asymmetry of the input image data based on the sub-loads; and generating a voltage control signal, which changes at least one of the high data voltage and the low data voltage, based on the sub-loads and the asymmetry, and wherein the generating the voltage control signal comprises: determining a supply voltage level of a first power voltage which is supplied to the display panel; calculating a second current-resistance drop of the first power voltage by analyzing the sub-loads; calculating a second local voltage level of the first power voltage by subtracting the second current-resistance drop from the supply voltage level; calculating a second target voltage level by subtracting a second offset voltage from the second local voltage level; and generating the voltage control signal based on the second target voltage level, wherein the voltage control signal adjusts the low data voltage.

7. The method of claim 6, wherein the second current-resistance drop of the first power voltage is calculated based on a maximum sub-load of the sub-loads.

8. The method of claim 6, wherein the driving transistor included in the pixel of the display panel is turned on in response to the low data voltage, and the second offset voltage has a substantially constant level determined based on a gate-source voltage of the turned-on driving transistor.

* * * * *